US008123505B2

(12) United States Patent
Nakanishi

(10) Patent No.: US 8,123,505 B2
(45) Date of Patent: Feb. 28, 2012

(54) RECIPROCATING PUMP WITH SEALING COLLAR ARRANGEMENT

(75) Inventor: Toshiro Nakanishi, Togane (JP)

(73) Assignee: Maruyama Mfg. Co., Inc., Tokyo (JP)

( * ) Notice: Subject to any disclaimer, the term of this patent is extended or adjusted under 35 U.S.C. 154(b) by 508 days.

(21) Appl. No.: 11/728,402

(22) Filed: Mar. 26, 2007

(65) Prior Publication Data

US 2008/0131299 A1 Jun. 5, 2008

(30) Foreign Application Priority Data

Dec. 4, 2006 (JP) ..... 2006-327223

(51) Int. Cl.
*F16J 15/00* (2006.01)

(52) U.S. Cl. ..... 417/559; 277/908; 277/909

(58) Field of Classification Search ..... 417/437, 417/567, 568, 559; 277/551, 572, 573, 908, 277/909

See application file for complete search history.

(56) References Cited

U.S. PATENT DOCUMENTS

| | | | | |
|---|---|---|---|---|
| 4,089,624 | A * | 5/1978 | Nichols et al. | 417/362 |
| 4,141,676 | A * | 2/1979 | Jannen et al. | 417/539 |
| 4,534,711 | A * | 8/1985 | Wakatsuki | 417/273 |
| 5,073,096 | A * | 12/1991 | King et al. | 417/454 |
| 6,304,724 | B1 * | 10/2001 | Ando | 396/29 |
| 2004/0161353 | A1 * | 8/2004 | Fabbri | 417/569 |
| 2006/0034717 | A1 * | 2/2006 | Castellone et al. | 417/423.14 |

FOREIGN PATENT DOCUMENTS

| | | | |
|---|---|---|---|
| JP | 63-69857 | | 5/1988 |
| JP | 63-259175 | | 10/1988 |
| JP | 1-318770 | | 12/1989 |
| JP | 3-71172 | | 7/1991 |
| JP | 2004-162646 | | 6/2004 |
| JP | 2005320935 | A * | 11/2005 |
| JP | 2006-52736 | | 2/2006 |

OTHER PUBLICATIONS

Machine Translation of JP2005320935.*
Japanese Office Action for Japanese Application No. 2006-327223, mailed on Jan. 6, 2009 (2 pages).
esp@cenet patent abstract for Japanese Pubilcation No. 1318770, Publication date Dec. 25, 1989 (1 page).
esp@cenet patent abstract for Japanese Publication No. 63259175, Publication date Oct. 26, 1988 (1 page).
esp@cenet abstract for Japanese Publication No. 2004162646; Publication dated Jun. 10, 2004 (1 page).

* cited by examiner

*Primary Examiner* — Devon C Kramer
*Assistant Examiner* — Nathan Zollinger
(74) *Attorney, Agent, or Firm* — Osha • Liang LLP

(57) ABSTRACT

An objective is to provide a reciprocating pump kept from lowering its performances, while restraining the cost from increasing.

Collars 14, 20, 21 made of a material more excellent in resistance to corrosion than a manifold 3 are interposed between the manifold 3 and sealing members 10, 22, 23 for liquid-tightly sealing the manifold 3, so as to prevent the parts in contact with the sealing members 10, 22, 23 from being corroded by a liquid for use, and fully exhibit sealing functions, thereby preventing leakage from occurring in a pump chamber 4 and the pressure oscillation from being increased by the leakage, while the collars 14, 20, 21 made of the material excellent in resistance to leakage are used only in the parts in contact with the sealing members 10, 22, 23.

14 Claims, 4 Drawing Sheets

RECIPROCATING PUMP WITH SEALING COLLAR ARRANGEMENT

BACKGROUND OF THE INVENTION

1. Field of the Invention

The present invention relates to a reciprocating pump.

2. Related Background Art

A reciprocating pump in which a reciprocating member reciprocates, so as to perform a pumping action, thereby sucking/discharging a liquid into/from a manifold has conventionally been known. This reciprocating pump is a pump in which the reciprocating member reciprocates, so that the liquid is sucked from the outside when a pump chamber formed within the manifold is depressurized, whereas the liquid is discharged to the outside when the pump chamber is pressurized. Since the pumping action is thus realized by pressure changes in the pump chamber, the pump chamber is liquid-tightly sealed with a seal packing or O-ring (see, for example, Patent Document 1).

[Patent Document 1] Japanese Patent Application Laid-Open No. 2004-162646

SUMMARY OF THE INVENTION

However, the conventional reciprocating pump has been problematic in that the manifold is corroded by the liquid for use, so that defects occur in sealing, whereby the liquid leaks from the pump chamber, and pressure oscillation increases because of the leakage, thus lowering performances of the reciprocating pump.

For solving such a technical problem, it is an object of the present invention to provide a reciprocating pump kept from lowering its performances.

The present invention provides a reciprocating pump (1) comprising a sealing member (10 or 22 or 23) for liquid-tightly sealing the inside of a manifold (3), wherein a reciprocating member (2) performs a pumping action for sucking a liquid for use into the manifold (3) and discharging the liquid therefrom by reciprocating; a collar (14 or 20 or 21) made of a material having a higher resistance to corrosion than the manifold (3) is liquid-tightly attached to an inner face of the manifold (3); and the sealing member (10 or 22 or 23) is liquid-tightly in contact with the collar (14 or 20 or 21).

The present invention provides a reciprocating pump (1) comprising: a manifold (3) having a pump chamber (4) and a channel (80) that connects the pump chamber (4) and the exterior; a plunger (2), mounted in the pump chamber (4), that reciprocates therein for sucking a liquid into the manifold (3) and discharging the liquid therefrom through the channel (80); a collar (14), made of a material having a higher resistance to corrosion than the manifold (3), that is liquid-tight and provided on a part of the side wall of the pump chamber (4); and a sealing member (10), provided between the collar (14) and the plunger (2), for providing a liquid-tight seal.

The present invention provides a reciprocating pump (1) comprising: a manifold (3) having a pump chamber (4) and a channel (80) that connects the pump chamber (4) and the exterior; a plunger (2), mounted in the pump chamber (4), that reciprocates therein for sucking a liquid into the manifold (3) and discharging the liquid therefrom through the channel (80); a valve member (90 or 91) provided in the channel (80); a collar (20 or 21), made of a material having a higher resistance to corrosion than the manifold (3), that is liquid-tight and provided on a part of the inner face of the channel (80); and a sealing member (22 or 23), provided between the collar (20 or 21) and the valve member (90 or 91), for providing a liquid-tight seal.

Thus, a collar made of a material more excellent in resistance to corrosion than a manifold is interposed between a part of the manifold in contact with a sealing member and the sealing member. This can prevent the part in contact with the sealing member from being corroded by the liquid for use, so that the sealing function is fully exhibited, whereby the leakage from the pump chamber can be prevented from occurring and increasing the pressure oscillation is prevented, thus keeping the reciprocating pump from lowering its performances. Since the collar made of a material excellent in resistance to corrosion is used only in the part in contact with the sealing member, it is not necessary for the manifold as a whole to be made of a material excellent in resistance to corrosion, which is economically advantageous.

Here, it will be preferred if the collar (14 or 20 or 21) is constituted by a material having a higher resistance to wear than the manifold (3). Such a structure can also prevent the part in contact with the sealing part from wearing, so that the sealing function can be exhibited more fully, thus further keeping the reciprocating pump from lowering its performances.

Preferably, the collar (14 or 20 or 21) has a chamfer (14*b* or 20*b* or 21*b*) and a groove (14*a* or 20*a* or 21*a*) in an outer peripheral part thereof, whereas an adhesive reservoir (60) is provided between the chamfer (14*b* or 20*b* or 21*b*) and the manifold (3) and also between the groove (14*a* or 20*a* or 21*a*) and the manifold (3). Such a structure allows an adhesive to fill the chamfer and groove, thereby yielding the adhesive reservoir, which can enhance the bonding strength and prevent the leakage from occurring.

Preferably, the distance (D1) between the chamfer (14*b* or 20*b* or 21*b*) of the collar (14 or 20 or 21) and a part (14*c*) of the collar (14 or 20 or 21) contacted to the liquid is shorter than the distance (D2) between the groove (14*a* or 20*a* or 21*a*) of the collar (14 or 20 or 21) and the part (14*c*).

Preferably, the sealing member (10) includes a spring (15), adapted to push a lip part (70) of the sealing member (10) inward.

Preferably, the collar (14) covers the lip part (70) of the sealing member (10).

Preferably, the collar (14 or 20 or 21) is press-fit into the manifold (3). Such a structure makes it possible to join the collar and manifold to each other without clearances, thereby preventing the leakage from occurring.

It will be preferred from economical viewpoints if the material for the collar (14 or 20 or 21) is stainless steel which is excellent in resistance to corrosion as compared with titanium or the like, for example. Stainless also inhibits wear, thereby further preventing the leakage from occurring and the pressure oscillation from being increased by the leakage.

The present invention can prevent the leakage from occurring and increasing the pressure oscillation, while keeping the cost from rising, whereby the reciprocating pump can be kept from lowering its performances.

DESCRIPTION OF THE PREFERRED EMBODIMENTS

Figure 1:
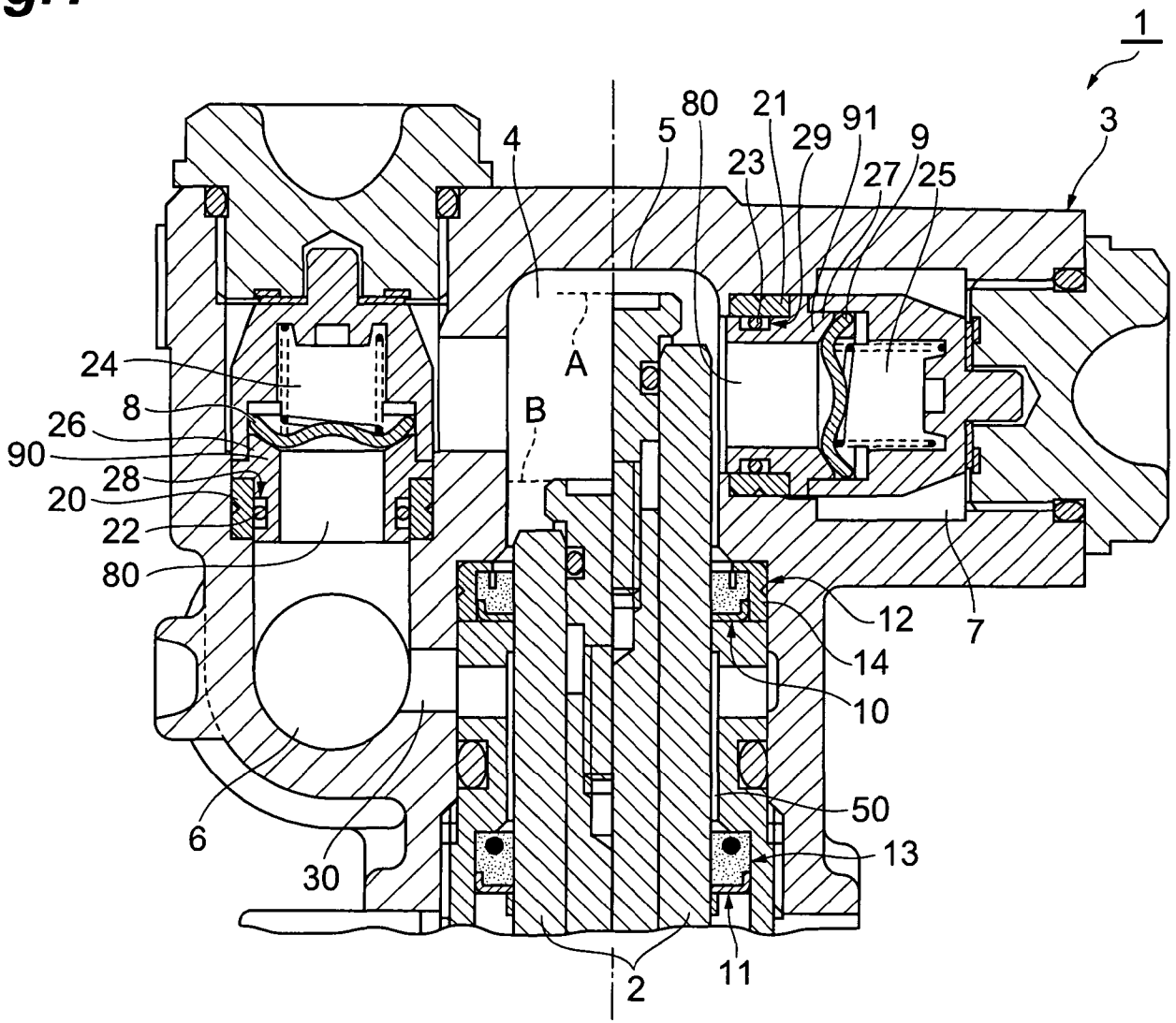
FIG. 1 A sectional view showing the reciprocating pump in accordance with an embodiment of the present invention.

In the following, an embodiment of the present invention will be explained with reference to the accompanying drawings. In the explanation of the drawings, the same constituents will be referred to with the same numerals without repeating their overlapping descriptions. Ratios of dimensions in the drawings do not always match those in the explanation.

Figure 2:
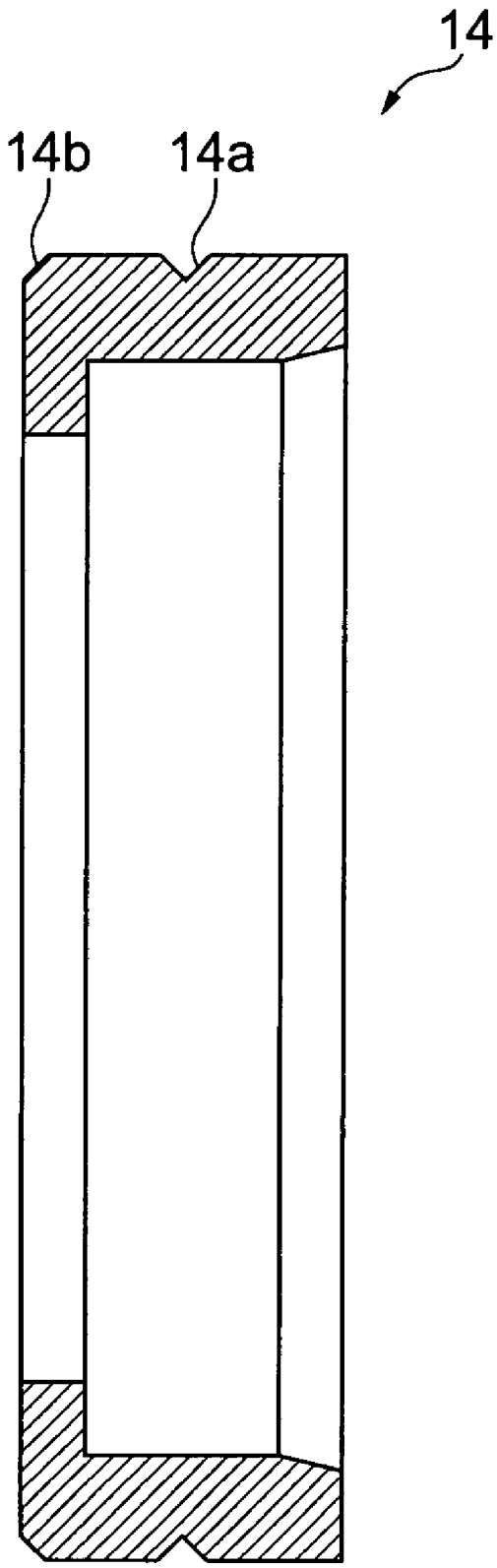
FIG. 2 A sectional view showing a collar in contact with an O-ring in FIG. 1.
Figure 3:
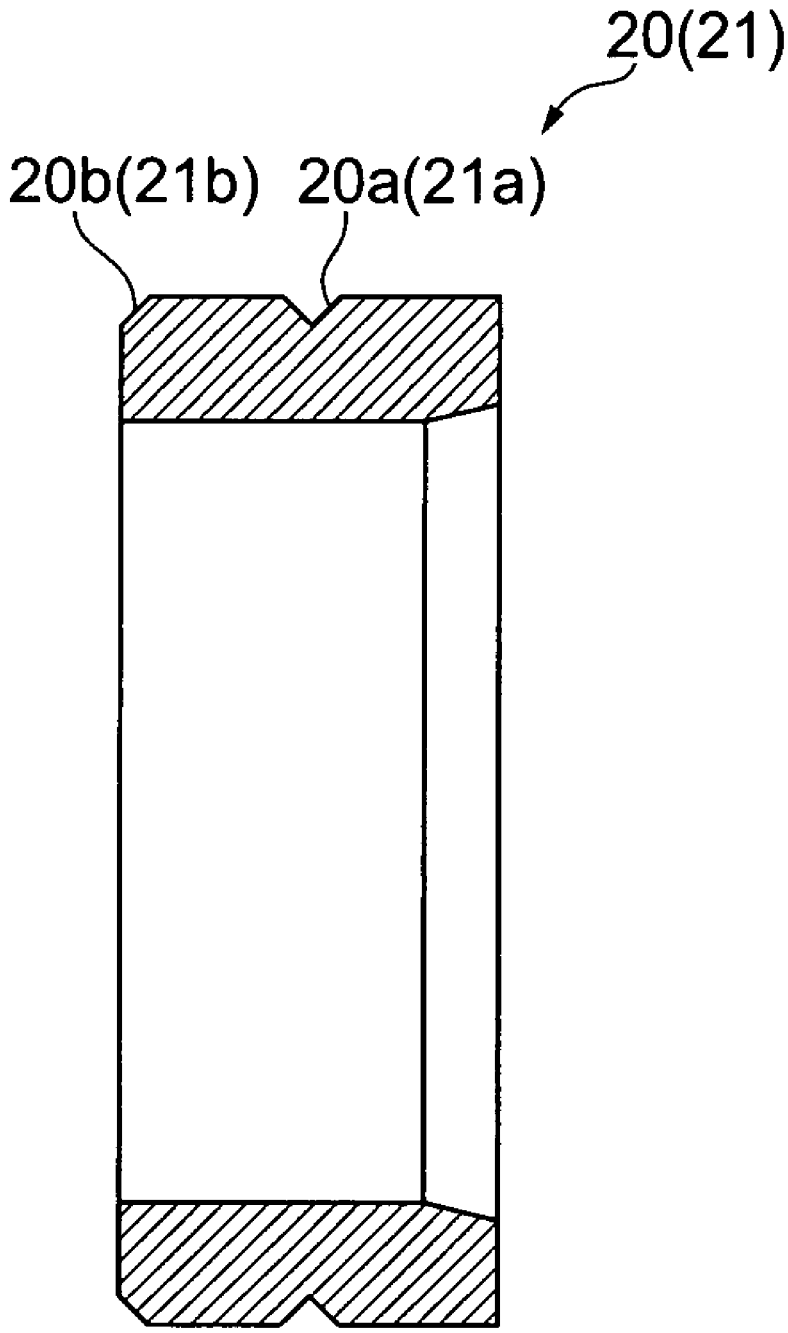
FIG. 3 A sectional view showing a collar in contact with a high-pressure seal in FIG. 1.
Figure 4:
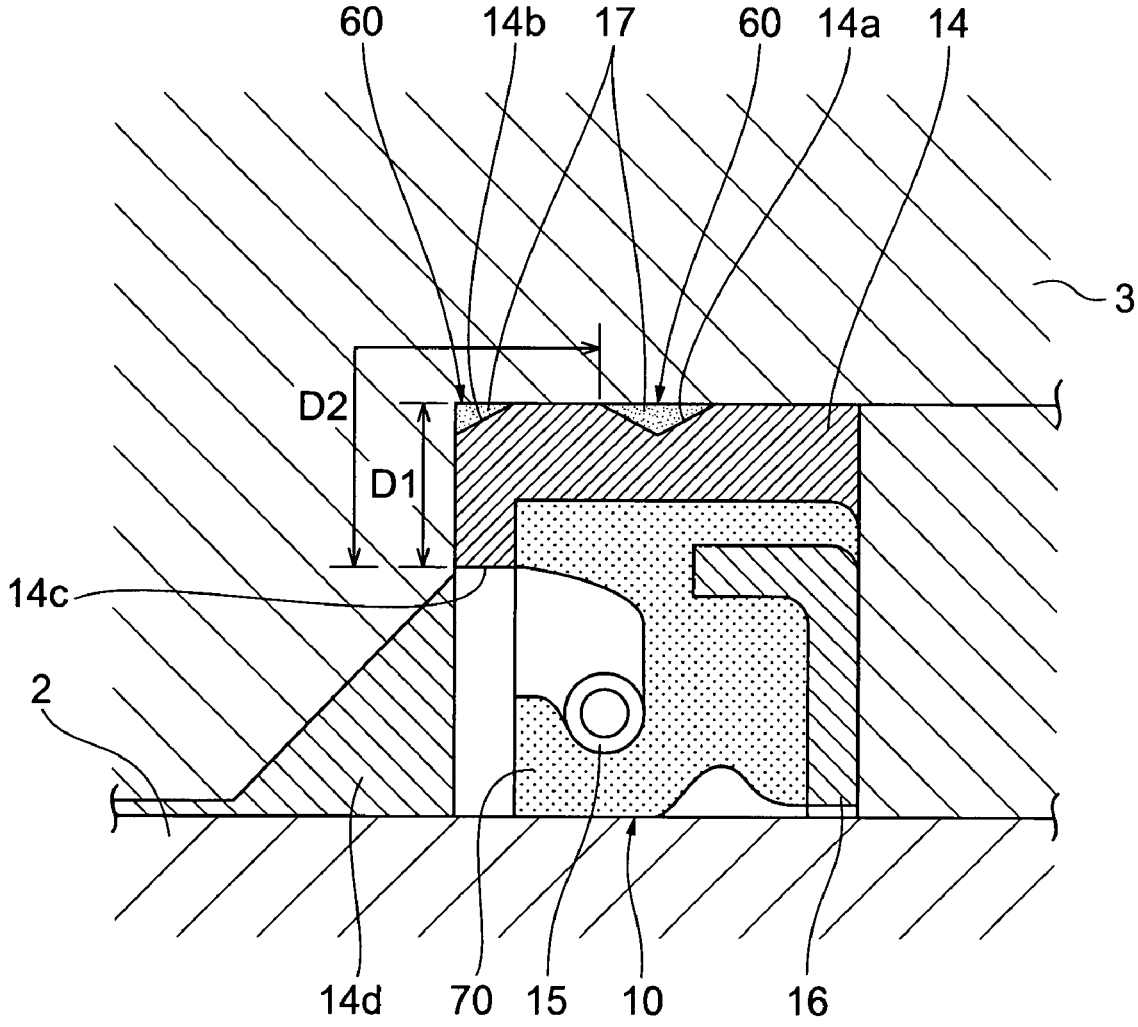
FIG. 4 A sectional view showing the high-pressure seal and collar in FIG. 1 under magnification.

FIG. 1 is a sectional view showing the reciprocating pump in accordance with the embodiment of the present invention. FIG. 2 is a sectional view showing a collar in contact with an O-ring in FIG. 1. FIG. 3 is a sectional view showing a collar in contact with a high-pressure seal in FIG. 1. FIG. 4 is a sectional view showing the high-pressure seal and collar in FIG. 1 under magnification. In FIG. 1, the parts on the right and left sides of the center line of a plunger 2 illustrate cases where the plunger 2 is located at its top dead center (see the broken line A in FIG. 1) and bottom dead center (see the broken line B in FIG. 1), respectively.

As shown in FIG. 1, the reciprocating pump 1 is a pump in which the plunger 2 constituting a reciprocating member reciprocates (moves up and down in the drawing), so as to perform a pumping action for sucking and discharging a liquid for use, and is favorably employed when releasing the liquid for use into which a detergent, wax, and the like are mixed in a washing machine used for washing a car, for example. The reciprocating pump 1 is equipped with a manifold 3 having a cylinder part 5 within which the plunger 2 is mounted and reciprocates. A pump chamber 4 formed on the leading end side within the cylinder part 5. The manifold 3 has a channel 80 that connects the pump chamber 4 and the exterior. Here, the manifold 3 is formed from brass.

The plunger 2 is connected to a driving source (not depicted) on its rear end side (the lower side in the drawing), whereas its leading end and the manifold 3 define the pump chamber 4. Under the control of the driving source, the plunger 2 reciprocates within the cylinder part 5, thereby pressurizing/depressurizing the pump chamber 4.

In the manifold 3, a suction port 6 and a discharge port 7 are formed in a communicating manner on one side and the other side of the pump chamber 4, respectively, so that the liquid for use circulates through the suction port 6, pump chamber 4, and discharge port 7 in succession. A suction valve 8 is provided in the channel 80 between the suction port 6 and pump chamber 4, and functions as a check valve which passes only a unidirectional flow from the suction port 6 to the pump chamber 4. On the other hand, a discharge valve 9 is provided in the channel 80 between the discharge port 7 and pump chamber 4, and functions as a check valve which passes only a unidirectional flow from the pump chamber 4 to the discharge port 7. The suction valve 8 and discharge valve 9 are pressed by elastic bodies 24, 25 with their fixed pressures, so as to be seated on a suction valve seat 26 and a discharge valve seat 27 under their urging forces, respectively, thereby closing the flow path. When the pressure within the pump chamber 4 changes, the valves 8, 9 move against the urging forces, so as to leave the suction valve seat 26 and discharge valve seat 27, respectively, thereby opening the flow path. The suction valve seat 26 and discharge valve seat 27 are held by the manifold 3.

The outer peripheral faces of the valve seats 26, 27 are provided with annular grooves 28, 29, to which O-rings (sealing members) 22, 23 are mounted, respectively. The O-rings 22, 23 are annular bodies formed from synthetic rubber, for example. Sealing contacts of the O-rings 22, 23 with the manifold 3 side will be explained later.

In the cylinder part 5, on the other hand, a high-pressure seal (sealing member) 10 and low-pressure seal 11 for preventing the liquid for use from leaking through the gap between the reciprocating plunger 2 and the cylinder part 5 are provided successively from the leading end side of the plunger 2 while being axially spaced from each other. The high-pressure seal 10 and low-pressure seal 11 are annular bodies provided with synthetic rubber, for example. The high-pressure seal 10 is placed in a larger-diameter part 12 formed on the pump chamber 4 side of the cylinder part 5, whereas the low-pressure seal 11 is placed in a larger-diameter part 13 formed closer to the driving source than the larger-diameter part 12 in the cylinder part 5. The high-pressure seal 10 is provided between the collar 14 and the plunger 2, for providing a liquid-tight seal. The high-pressure seal 10 and low-pressure seal 11 are arranged such as to come into liquid-tightly sliding contact with the outer peripheral face of the plunger 2 when the plunger 2 reciprocates. The mounting of the high-pressure seal 10 and low-pressure seal 11 to the manifold 3 will be explained later. An annular cooling path 50 for cooling the plunger 2 is provided between the larger-diameter parts 12, 13.

The suction port 6 is connected to the cooling path 50 through a communicating path 30, so that a part of the liquid for use sucked from the suction port 6 is supplied through the communicating path 30. Consequently, the plunger 2 is cooled with the liquid for use.

In this embodiment in particular, a collar 14 is provided between the high-pressure seal 10 and manifold 3, whereas collars 20, 21 are provided between the manifold 5 and the suction valve seat 26 and discharge valve seat 27, respectively.

The collar 14 on the high-pressure seal 10 side is formed from a material which is superior to the manifold 3 in terms of resistances to corrosion and wear, e.g., stainless. As shown in FIGS. 1 and 4, the collar 14 is formed on a part of the side wall of the pump chamber 4. The collar 14 is an annular body, while the outer peripheral part of the collar 14 is provided with an annular groove 14*a* and a chamfer 14*b* in the end part. The fit between the collar 14 and manifold 3 is a press-fitting tolerance. Namely, the outer-diameter of collar 14 is subtlely bigger than the inner-diameter of the groove of the manifold 13 containing the collar 14. The outer peripheral face of the collar 14 is coated with an adhesive 17. Therefore, the collar 14 is press-fitted into the manifold 3, so as to be liquid-tightly attached thereto. As shown in FIG. 4, adhesive reservoirs 60 are formed in the groove 14*a* and chamfer 14*b*, so as to enhance the bonding strength, whereby the collar 14 and manifold 3 are attached to each other more liquid-tightly. The distance D1 between the chamfer 14*b* of a collar 14 and a part 14*c* of the collar 14 contacted to the liquid is shorter than the distance D2 between the groove 14*a* of the collar 14 and the part 14*c*. Here, the liquid is located in the part 14*d* in FIG. 4. The above-mentioned high-pressure seal 10 is liquid-tightly in contact with the collar 14 by fitting against the inner peripheral face of the collar 14. A core 16 is buried within the high-pressure seal 10. When the high-pressure seal 10 is attached to the collar 14, a spring 15 in the high-pressure seal 10 pushes a lip part 70 of the high-pressure seal 10 inward, whereby the high-pressure seal 10 comes into liquid-tightly sliding contact with the outer peripheral face of the plunger 2. Also, as shown in FIG. 4, the collar 14 covers the lip part 70 of the of the high-pressure seal 10. Also, as shown in FIG. 1, the low-pressure seal 11 is fixed by fitting to the manifold 3 side, whereby the low-pressure seal 11 comes into liquid-tightly sliding contact with the outer peripheral face of the plunger 2.

The collars 20, 21 on the side of the valve seats 26, 27 will now be explained. Since these collars 20, 21 are constructed similarly to each other, only the collar 20 will be explained here with reference to FIG. 3. As with the collar 14, the collar 20 is formed from a material superior to the manifold 3 in terms of resistances to corrosion and wear, e.g., stainless. The collar 20 is formed on a part of the inner face of the channel 80. The collar 20 is an annular body, while the outer peripheral part of the collar 20 is provided with an annular groove 20*a* and a chamfer 20*b* in the end part. The fit between the collar 20 and manifold 3 is a press-fitting tolerance. Namely, the outer-diameter of collar 20 is subtlely bigger than the inner-diameter of the groove of the manifold 13 containing the collar 20. The outer peripheral face of the collar 20 is coated with an adhesive 17. Therefore, the collar 20 is press-fitted into the manifold 3, so as to be liquid-tightly attached thereto. Adhesive reservoirs 60 filled with the adhesive 17 are formed in the groove 20*a* and chamfer 20*b* as in the case of the collar 14, so as to enhance the bonding strength, whereby the collar 20 and manifold 3 are attached to each other more liquid-tightly. As shown in FIG. 1, the above-mentioned suction valve seat 26 and discharge valve seat 27 are inserted into the collars 20, 21, whereby the O-rings 22, 23 are pressed against the inner peripheral faces of the collars 20, 21 and liquid-tightly in contact therewith. Namely, the O-rings 22, 23 are provided between the collars 20, 21 and the valve members 90, 91 composed of valves 8, 9 and the valve seats 26, 27, respectively.

Operations and effects of the reciprocating pump 1 in accordance with this embodiment will now be explained.

First, the driving source (not depicted) is activated, whereby the plunger 2 reciprocates within the cylinder part 5. When the plunger 2 moves toward the position of the bottom dead center (see the broken line B) in FIG. 1, the pump chamber 4 is depressurized, so that the suction valve 8 and discharge valve 9 are opened and closed, respectively, whereby the liquid for use is sucked into the pump chamber 4 through the suction valve 8 from the suction port 6. When the plunger 2 moves toward the position of the top dead center (see the broken line A), on the other hand, the pump chamber 4 is pressurized, so that the suction valve 8 and discharge valve 9 are closed and opened, respectively, whereby the liquid for use is discharged from the pump chamber 4 to the discharge port 7 through the discharge valve 9. These sucking and discharging steps are repeated, so that the liquid for use is unidirectionally transferred from the suction port 6 to the discharge port 7.

Since the liquid for use contains the detergent and wax that corrode the manifold 3, corrosion has conventionally occurred in the parts in contact with the seal parts, while the seal parts oscillate as the pump chamber 4 is repeatedly pressurized and depressurized, so that the oscillation causes the corrosion to progress in the oscillating direction and additionally generates wear in the manifold 3, whereby the corrosion and wear lower the sealing function and generate leakage, while the pressure oscillation is increased by the leakage. Since the parts in contact with the high-pressure seal 10 and O-rings 22, 23 are the collars 14, 20, 21 excellent in resistance to corrosion in the reciprocating pump 1 in accordance with this embodiment, by contrast, the parts in contact with the high-pressure seal 10 and O-rings 22, 23 can be prevented from being corroded by the liquid for use, so that the sealing function is fully exhibited, thus preventing leakage from occurring in the pump chamber 4 and the pressure oscillation from being increased by the leakage, thereby keeping the reciprocating pump 1 from lowering its performances. Since the parts in contact with the high-pressure seal 10 and O-rings 22, 23 are the collars 14, 20, 21 excellent in resistance to wear, they are also kept from wearing and can further prevent leakage from occurring in the pump chamber 4 and the pressure oscillation from being increased by the leakage.

Employing the collars 14, 20, 21 makes it unnecessary to change the material of the whole manifold 3, whereby performances can be prevented from lowering, while keeping the cost from increasing.

Since the collars 14, 20, 21 have the chamfers 14*b*, 20*b*, 21*b* and grooves 14*a*, 20*a*, 21*a* in their outer peripheral parts, while gaps between the manifold 3 and the chamfers and grooves are filled with the adhesive 17, so as to form the adhesive reservoirs 60, the bonding strength is enhanced while leakage can be prevented from occurring.

Since the fits between the collars 14, 20, 21 and the manifold 3 are press-fitting tolerances, the collars 14, 20, 21 can be joined to the manifold 3 without clearances, whereby leakage can be prevented from occurring.

Though a preferred embodiment of the present invention is specifically explained in the foregoing, the above-mentioned embodiment illustrates only an example of the reciprocating pump in accordance with the present invention, whereas the present invention is not limited to the reciprocating pump in accordance with the above-mentioned embodiment. For example, the liquid for use is not limited to those containing detergents and waxes, whereby any liquid containing a component corroding the manifold 3 is employable.

Though the collars 14, 20, 21 are made of stainless because of its economical superiority, they may be made of any materials, e.g., titanium, as long as they attain a higher resistance to corrosion, and preferably a higher resistance to wear, than the manifold 3.

What is claimed is:

1. A reciprocating pump comprising sealing members for liquid-tightly sealing the inside of a manifold formed from brass, wherein a reciprocating member performs a pumping action for sucking a liquid containing a detergent or wax into the manifold and discharging the liquid therefrom by reciprocating;

wherein a valve collar and a cylinder collar made of stainless steel or titanium having a higher resistance to corrosion than the manifold and a higher resistance to wear than the manifold are liquid-tightly attached to an inner face of the manifold;

wherein one of the sealing members, which is arranged on an inner periphery of the valve collar, is liquid-tightly in contact with the valve collar and in no contact with the manifold;

wherein the one of the sealing members is arranged between the valve collar and a valve member, for providing a liquid-tight seal, and no sealing member is arranged between the valve collar and the manifold;

wherein another one of the sealing members, which is arranged on an inner periphery of the cylinder collar, is liquid-tightly in contact with the cylinder collar and in no contact with the manifold;

wherein the another one of the sealing members is arranged between the cylinder collar and a plunger, for providing a liquid-tight seal; and wherein, in response to the reciprocation of the reciprocating member, the sealing members are repeatedly pressurized and depressurized in the manifold.

2. A reciprocating pump according to claim 1, wherein one of the valve and cylinder collars has a chamfer and a groove in an outer peripheral part thereof, and wherein an adhesive reservoir is provided between the chamfer and the manifold and also between the groove and the manifold.

3. A reciprocating pump according to claim 2, wherein the distance between the chamfer of one of the valve manifold and cylinder collars and a part of the one of the collars contacted to the liquid is shorter than the distance between the groove of the one of the collars and the part.

4. A reciprocating pump according to claim 1, wherein the valve collar and the cylinder collar are press-fit into the manifold, and wherein no sealing member is arranged between the cylinder collar and the manifold.

5. A reciprocating pump, comprising:

a manifold formed from brass having a pump chamber and a channel that connects the pump chamber and an exterior of the pump chamber;

a plunger, mounted in the pump chamber, that reciprocates therein for sucking a liquid containing a detergent or wax into the manifold and discharging the liquid therefrom through the channel;

a cylinder collar, made of stainless steel or titanium having a higher resistance to corrosion than the manifold and a higher resistance to wear than the manifold, that is liquid-tight and provided on a part of the side wall of the pump chamber; and a sealing member, provided between the cylinder collar and the plunger, for providing a liquid-tight seal, wherein the sealing member, which is arranged on an inner periphery of the cylinder collar, is in no contact with the pump chamber, wherein the cylinder collar is press-fit into the manifold, wherein no sealing member is arranged between the cylinder collar and the manifold, and wherein, in response to the reciprocation of the plunger, the sealing member is repeatedly pressurized and depressurized in the manifold.

6. A reciprocating pump according to claim 5, wherein the cylinder collar has a chamfer and a groove in an outer peripheral part thereof, and wherein an adhesive reservoir is provided between the chamfer and the manifold and also between the groove and the manifold.

7. A reciprocating pump according to claim 6, wherein the distance between the chamfer of the cylinder collar and a part of the cylinder collar contacted to the liquid is shorter than the distance between the groove of the cylinder collar and the part.

8. A reciprocating pump according to claim 5, wherein the sealing member includes a spring, adapted to push a lip part of the sealing member inward.

9. A reciprocating pump according to claim 8, wherein the cylinder collar covers the lip part of the sealing member.

10. A reciprocating pump according to claim 5, wherein the cylinder collar is press-fit into the pump chamber.

11. A reciprocating pump comprising:

a manifold formed from brass having a pump chamber and a channel that connects the pump chamber and an exterior;

a plunger, mounted in the pump chamber, that reciprocates therein for sucking a liquid containing a detergent or wax into the manifold and discharging the liquid therefrom through the channel;

a valve member provided in the channel;

a valve collar, made of stainless steel or titanium having a higher resistance to corrosion than the manifold and a higher resistance to wear than the manifold, that is liquid-tight and provided on a part of the inner face of the channel; and a sealing member, provided between the valve collar and the valve member, for providing a liquid-tight seal, wherein the sealing member, which is arranged on an inner periphery of the valve manifold collar, is in no contact with the manifold, wherein the valve collar is press-fit into the manifold, wherein no sealing member is arranged between the valve collar and the manifold, and wherein, in response to the reciprocation of the plunger, the sealing member is repeatedly pressurized and depressurized in the manifold.

12. A reciprocating pump according to claim 11, wherein the valve collar has a chamfer and a groove in an outer peripheral part thereof, and wherein an adhesive reservoir is provided between the chamfer and the manifold and also between the groove and the manifold.

13. A reciprocating pump according to claim 12, wherein the distance between the chamfer of the valve collar and a part of said valve collar contacted to the liquid is shorter than the distance between the groove of said valve collar and said part.

14. A reciprocating pump according to claim 11, wherein the valve collar is press-fit into the channel.

* * * * *